US005145828A

United States Patent [19]

Etzbach et al.

[11] Patent Number: 5,145,828

[45] Date of Patent: Sep. 8, 1992

[54] TRANSFER OF AZO DYES

[75] Inventors: Karl-Heinz Etzbach, Frankenthal; Ruediger Sens, Mannheim; Matthias Wiesenfeldt, Mutterstadt, all of Fed. Rep. of Germany

[73] Assignee: BASF Aktiengesellschaft, Ludwigshafen, Fed. Rep. of Germany

[21] Appl. No.: 651,455

[22] Filed: Feb. 5, 1991

[30] Foreign Application Priority Data

Feb. 15, 1990 [DE] Fed. Rep. of Germany ..... 4004600

[51] Int. Cl.[5] ..... B41M 5/035; B41M 5/26

[52] U.S. Cl. ..... 503/227; 428/195; 428/913; 428/914

[58] Field of Search ..... 8/471; 428/195, 913, 428/914; 503/227

[56] References Cited

U.S. PATENT DOCUMENTS

| | | | |
|---|---|---|---|
| 4,764,178 | 8/1988 | Gregory et al. | 8/471 |
| 5,011,812 | 4/1991 | Bradbury | 503/227 |

FOREIGN PATENT DOCUMENTS

| | | | |
|---|---|---|---|
| 216483 | 4/1987 | European Pat. Off. | 503/227 |
| 235939 | 9/1987 | European Pat. Off. | 503/227 |
| 258856 | 3/1988 | European Pat. Off. | 503/227 |
| 344592 | 12/1989 | European Pat. Off. | 503/227 |
| 352006 | 1/1990 | European Pat. Off. | 503/227 |

*Primary Examiner*—B. Hamilton Hess

*Attorney, Agent, or Firm*—Oblon, Spivak, McClelland, Maier & Neustadt

[57] ABSTRACT

One or more azo dyes are transferred from a transfer to a sheet of plastic-coated paper by diffusion with the aid of an energy source, said azo dyes having the formula where X is nitrogen or the radical C—CN, Z is oxygen or the radical —CH($R^7$)—, where $R^7$ is hydrogen or $C_1$–$C_4$-alkyl, $R^1$ is hydrogen, substituted or unsubstituted alkyl or phenyl, $R^2$ and $R^3$ are hydrogen or $C_1$–$C_4$-alkyl, $R^4$ is hydrogen, $C_1$–$C_{10}$-alkyl, $C_1$–$C_{10}$-alkoxy or acylamino, $R^5$ is hydrogen, chlorine, $C_1$–$C_4$-alkyl, $C_1$–$C_4$-alkoxy, $C_1$–$C_4$-alkylthio or unsubstituted or substituted phenyl, and $R^6$ is cyano or the radical —CO—OR$^1$, —CO—NHR$^1$ or —CO—N(R$^1$)$_2$, in each of which $R^1$ is as defined above.

3 Claims, No Drawings

TRANSFER OF AZO DYES

The present invention relates to a novel process for transferring azo dyes with a thiophene-based diazo component from a transfer to a sheet of plastic-coated paper with the aid of an energy source.

In the thermotransfer printing process, a transfer sheet which contains a thermally transferable dye in one or more binders on a support, with or without suitable assistants, is heated from the back with an energy source, for example a thermal printing head, in short pulses (lasting fractions of a second), causing the dye to migrate out of the transfer sheet and to fuse into the surface coating of a receiving medium. The essential advantage of this process is that the amount of dye to be transferred (and hence the color gradation) is readily controllable through adjustment of the energy to be emitted by the energy source.

In general, color recording is carried out using the three substractive primaries yellow, magenta and cyan (with or without black). To ensure optical color recording, the dyes must have the following properties:

- ready thermal transferability,
- little tendency to migrate within or out of the surface coating of the receiving medium at room temperature,
- high thermal and photochemical stability and resistance to moisture and chemical substances,
- suitable hues for substractive color mixing,
- a high molar absorption coefficient,
- no tendency to crystallize out on storage of the transfer sheet,
- ready industrial accessibility.

These requirements are very difficult to meet at one and the same time.

For this reason most of the existing thermal transfer dyes do not have the required combination of properties.

There is a prior art concerned with thermotransfer printing dyes. For instance, EP-A-216 483 and EP-A-258 856 describe azo dyes which possess diazo components based on thiophene and coupling components based on aniline.

Furthermore, EP-A-218 937 discloses thiophene-and aniline-based disazo dyes for this purpose.

In addition, EP-A-302 682 discloses the thermotransfer of azo dyes which are derived from 2-aminothiophenes which have a fused carbonyl group in ring position 5.

It is an object of the present invention to provide a process for transferring azo dyes in which the dyes shall substantially meet the abovementioned requirements.

We have found that this object is achieved by a process for transferring azo dyes from a transfer to a sheet of plastic-coated paper by diffusion with the aid of an energy source by using a transfer of which there is or are one or more azo dyes of the formula I

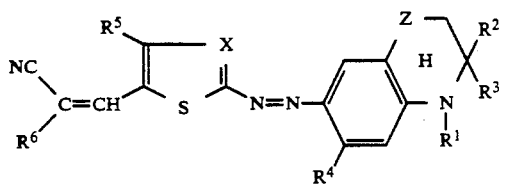

(I)

where

X is nitrogen or the radical C—CN,

Z is oxygen or the radical —CH($R^7$)—, where $R^7$ is hydrogen or $C_1$–$C_4$-alkyl, $R^1$ is alkyl, alkanoyloxyalkyl, alkoxycarbonyloxyalkyl or alkoxycarbonylalkyl, which each have up to 15 carbon atoms and may be substituted by phenyl, $C_1$–$C_4$-alkylphenyl, $C_1$–$C_4$-alkoxyphenyl, halophenyl, benzyloxy, $C_1$–$C_4$-alkylbenzyloxy, $C_1$–$C_4$-alkoxybenzyloxy, halogen, hydroxyl or cyano, hydrogen, unsubstituted or $C_1$–$C_{15}$-alkyl-, $C_1$–$C_{15}$-alkoxy- or halogen-substituted phenyl or a radical of the formula II $$[-Y-O]_m-R^8 \qquad \text{(II)}$$

where

Y is $C_2$–$C_6$-alkylene, m is 1, 2, 3, 4, 5 or 6, and $R^8$ is $C_1$–$C_4$-alkyl or unsubstituted or $C_1$–$C_4$-alkyl- or $C_1$–$C_4$-alkoxy-substituted phenyl, $R^2$ and $R^3$ are identical or different and each is independently of the other hydrogen or $C_1$–$C_4$-alkyl, $R^4$ is hydrogen, $C_1$–$C_{10}$-alkyl, $C_1$–$C_{10}$-alkoxy or the radical —NH—$COR^2$ or —$NHSO_2R^8$, where $R^2$ and $R^8$ are each as defined above, $R^5$ is hydrogen, chlorine, $C_1$–$C_4$-alkyl, $C_1$–$C_4$-alkoxy, $C_1$–$C_4$-alkylthio or unsubstituted or $C_1$–$C_4$-alkyl-, $C_1$—$C_4$-alkoxy- or halogen-substituted phenyl, and $R^6$ is cyano or the radical —CO—$OR^1$, —CO—$NHR^1$ or —CO—$N(R^1)_2$, in each of which $R^1$ is as defined above.

Any alkyl or alkylene appearing in the abovementioned formula I may be either straight-chain or branched.

Y in the formula I is for example ethylene, 1,2-or 1,3-propylene, 1,2-, 1,3-, 1,4- or 2,3-butylene, pentamethylene, hexamethylene or 2-methylpentamethylene.

Suitable $R^1$, $R^2$, $R^3$, $R^4$, $R^5$ or $R^7$ in the formula I is for example methyl, ethyl, propyl, isopropyl, butyl, isobutyl, sec-butyl or tert-butyl.

$R^1$ and $R^4$ may each also be for example pentyl, isopentyl, neopentyl, tert-pentyl, hexyl, 2-methylpentyl, heptyl, octyl, 2-ethylhexyl, isooctyl, nonyl, isononyl, decyl or isodecyl.

$R^1$ may also be for example undecyl, dodecyl, tridecyl, isotridecyl (the terms isooctyl, isononyl, isodecyl and isotridecyl are trivial names derived from the oxo process alcohols—cf. Ullmanns Encyklopädie der technischen Chemie, 4th edition, Volume 7, pages 215 to 217, and Volume 11, pages 435 and 436), tetradecyl, pentadecyl, hexadecyl, heptadecyl, octadecyl, nonadecyl, icosyl, benzyl, 1- or 2-phenylethyl,

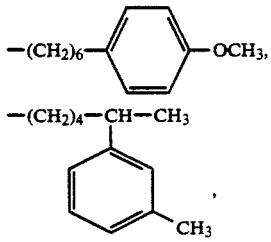

-continued
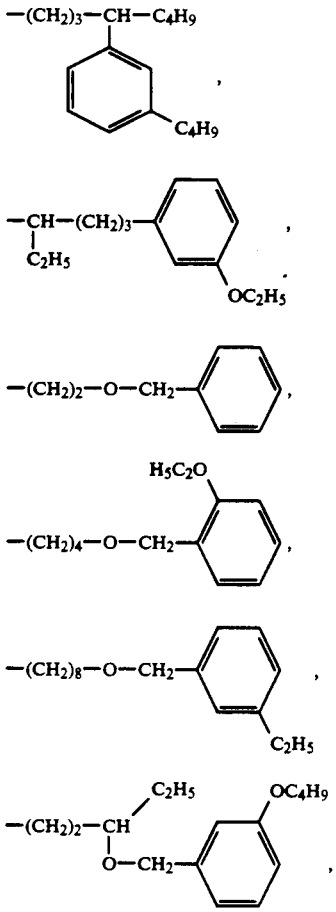
3-hydroxybutyl, 3-hydroxyheptyl, 10-hydroxy-1-ethyldecyl, 2-cyanoethyl, 3-cyanopropyl, 3-cyano-2-methylpentyl, 7-cyanononyl, 7-cyano-4-methylocyl, 5-chloropentyl, 4-chloro-1-butylbutyl, 5,5,5-trifluoropentyl,
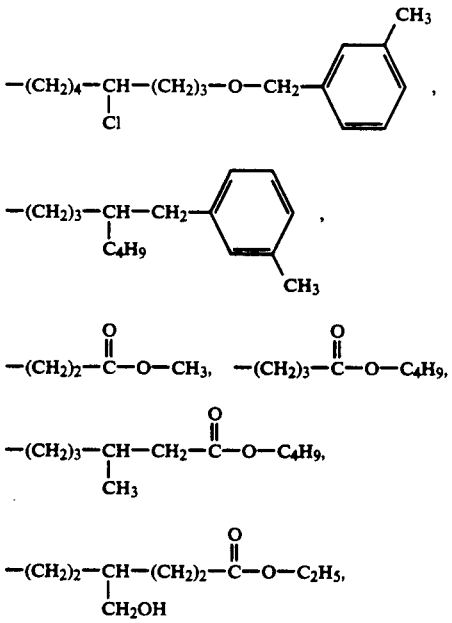
-continued
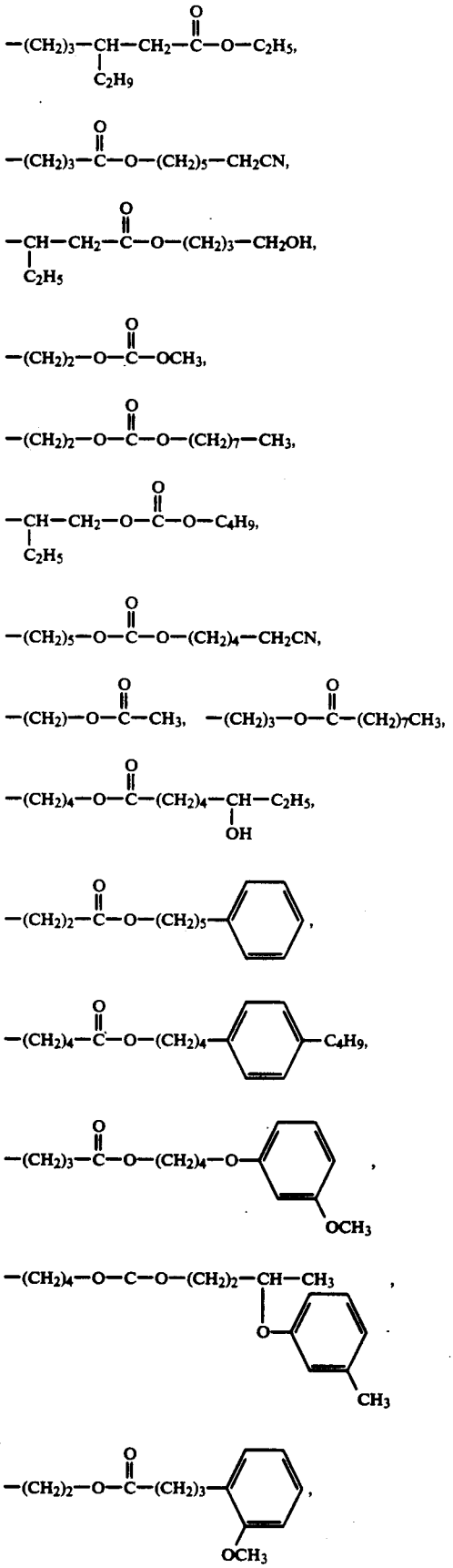

-continued

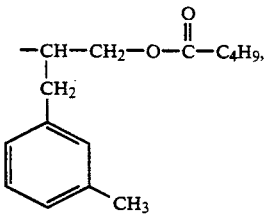

phenyl, 2-methylphenyl, 4-butoxyphenyl, 4-undecylophenyl, 4-chlorophenyl,

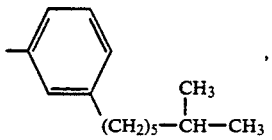

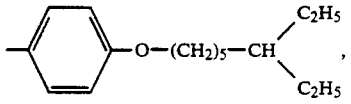

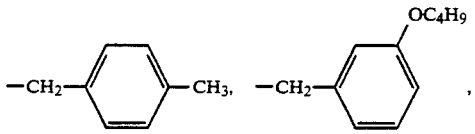

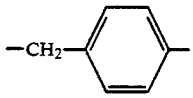

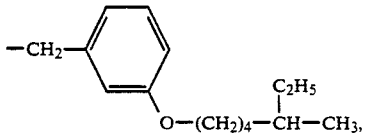

$-(CH_2)_2-O-CH_3$, $-(CH_2)_2-O-C_2H_5$, $-(CH_2)_3-CH(CH_3)-CH_2-O-C_4H_9$, $-(CH_2)_6-O-C_4H_9$, $-(CH_2)_2-O-CH_2-CH(CH_3)-CH_3$,

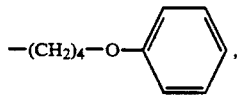

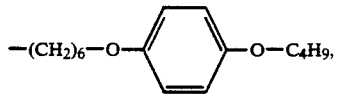

$\text{+}CH_2-CH_2-O\text{+}_{12}CH_3$, $\text{+}CH_2-CH_2-O\text{+}_{13}C_4H_9$, $\text{+}CH_2-CH_2-O\text{+}_{14}OCH_3$,

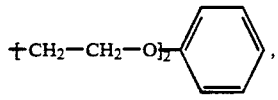

-continued

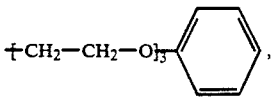

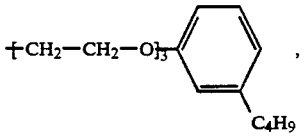

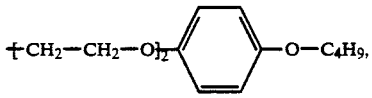

$\text{+}CH_2-CH_2-CH(CH_3)-O\text{+}_{12}C_2H_5$ or $\text{+}CH_2-CH_2-CH_2-CH_2-O\text{+}_{12}C_2H_5$.

$R^4$ and $R^5$ may each also be for example methoxy, ethoxy, propoxy, isopropoxy, butoxy, isobutoxy or sec-butoxy.

$R^4$ may also be for example pentyloxy, isopentyloxy, neopentyloxy, hexyloxy, heptyloxy, octyloxy, 2-ethylhexyloxy, nonyloxy or decyloxy.

$R^5$ may also be for example methylthio, ethylthio, propylthio, isopropylthio or butylthio.

The process according to the present invention is preferred when there are on the transfer one or more azo dyes of the formula I where $R^1$ is alkyl, alkanoyloxyalkyl or alkyloxycarbonylalkyl, which each have up to 12 carbon atoms and may be substituted by hydroxyl or cyano, or a radical of the formula II $$[-Y-O]_m-R^8 \qquad \text{(II)}$$

where

Y is $C_2$-$C_4$-alkylene, m is 1, 2, 3 or 4, and $R^8$ is $C_1$-$C_4$-alkyl or unsubstituted or $C_1$-$C_4$-alkyl- or $C_1$-$C_4$-alkoxy-substituted phenyl, $R^4$ is hydrogen, $C_1$-$C_6$-alkyl, $C_1$-$C_6$-alkoxy or the radical $-NH-COR^2$ or $-NHSO_2R^8$, where $R^2$ and $R^8$ are each as defined above, $R^5$ is hydrogen, chlorine, $C_1$-$C_4$-alkyl, $C_1$-$C_4$-alkoxy or phenyl, and $R^6$ is cyano or the radical $-CO-OR^1$, $-CO-NHR^1$ or $-CO-N(R^1)_2$, in each of which $R^1$ conforms to the most recent definition of $R^1$.

Particular preference is given to the novel process when the, transfer used has on it one or more azo dyes of the formula Ia

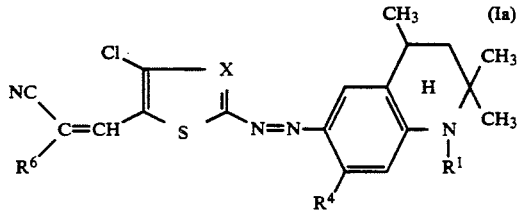

(Ia)

where

X is nitrogen or the radical C—CN, $R^1$ is $C_1$–$C_6$-alkyl or a radical of the formula III $$[-CH_2-CH_2-O]_n-R^8 \quad \text{(III)}$$

where n is 1 or 2 and $R^8$ is $C_1$–$C_4$-alkyl, $R^4$ is hydrogen, methyl, methoxy or $C_2$–$C_5$-alkanoylamino, and $R^6$ is cyano ox the radical —CO—$OR^1$, where $R^1$ conforms to the most recent definition.

The dyes of the formula I are known from EP-A-201 896 or can be obtained by the methods mentioned therein.

Compared with the dyes used in existing processes, the transfer dyes for the novel process generally possess improved migration properties in the receiving medium at room temperature, readier thermal transferability, higher photochemical stability, readier industrial accessibility, better resistance to moisture and chemical substances, higher color strength, better solubility, higher purity of hue and higher thermal stability.

It is also surprising that the dyes of the formula I are readily transferable despite their relatively high molecular weight.

To prepare the dye transfers required for the process, the dyes are incorporated into a suitable organic solvent, for example chlorobenzene, isobutanol, methyl ethyl ketone, methylene chloride, toluene, tetrahydrofuran or a mixture thereof, together with one or more binders and possibly further assistants to form a printing ink in which the dye is preferably present in a molecularly dispersed, ie. dissolved, form. The printing ink can then be applied to an inert support by knife coating and air dried.

Suitable binders are all resins or polymer materials which are soluble in organic solvents and capable of binding the dye to the inert support in a form in which it will not rub off. Preference is given here to those binders which, after the printing ink has been air dried, hold the dye in a clear, transparent film in which no visible crystallization of the dye occurs.

Examples of such binders are cellulose derivatives, eg. methylcellulose, ethylcellulose, ethylhydroxyethylcellulose, hydroxypropylcellulose, cellulose acetate or cellulose acetobutyrate, starch, alginates, alkyd resins, vinyl resins, polyvinyl alcohol, polyvinyl acetate, polyvinyl butyrate and polyvinylpyrrolidones. It is also possible to use polymers and copolymers of acrylates or their derivatives, such as polyacrylic acid, polymethyl methacrylate or styrene- acrylate copolymers, polyester resins, polyamide resins, polyurethane resins or natural CH resins such as gum arabic. Further suitable binders are described for example in DE-A-3 524 519.

Preferred binders are ethyl cellulose, ethylhydroxyethylcellulose and polyvinyl butyrate.

The ratio of binder to dye may vary, preferably from 5:1 to 1:1.

Possible assistants are release agents as mentioned in EP-A-227 092, EP-A-192 435 and the patent applications cited therein, but also in particular organic additives which prevent the transfer dyes from crystallizing out in the course of storage and heating of the inked ribbon for example cholesterol or vanillin.

Inert support materials are for example tissue, blotting or parchment paper and plastics films possessing good heat resistance, for example metallized or unmetallized polyester, polyamide or polyimide.

The inert support may additionally be coated on the side facing the thermal printing head with a lubricant or slipping layer in order that adhesion of the thermal printing head to the support material may be prevented. Suitable lubricants are described for example in EP-A-216 483 and EP-A-227 095. The thickness of the support for the dye is in general from 3 to 30 μm, preferably from 5 to 10 μm.

The dye-receiving layer can be basically any heat resistant plastics layer which possesses affinity for the dyes to be transferred and whose glass transition temperature should be below 150° C., for example a modified polycarbonate or polyester. Suitable recipes for the receiving layer composition are described in detail for example in EP-A-227 094, EP-A-133 012, EP-A-133 011, JP-A-199 997/1986, JP-A-283 595/1986, JP-A-237 694/1986 and JP-A-127 392/1986.

The transfer is effected by means of an energy source, for example by means of a laser or by means of a thermal printing head which must be heatable to ≧300° C. in order that the transfer of the dye may take place within the time range t: $0<t<15$ msec. In the course of transfer, the dye migrates out of the transfer sheet and diffuses into the surface coating of the receiving medium.

Further details concerning the preparation may be discerned from the Examples which follow, in which the percentages are by weight, unless otherwise stated.

Transfer of dyes

For a simple quantitative examination of the transfer characteristics of the dyes, the thermal transfer was effected with large hotplates instead of a thermal printing head, the transfer temperature being varied within the range 70° C. $<T<$ 120° C. while the transfer time was fixed at 2 minutes.

A) General recipe for coating the support with dye: 1 g of binder was dissolved in 8 ml of 8:2 v/v toluene/ethanol at 40°–50° C. A solution of 0.25 g of dye in 5 ml of tetrahydrofuran was added with stirring. The print paste thus obtained was applied with an 80 μm doctor blade to a polyester sheet (thickness: 6–10 μm) and dried with a hair dryer.

B) Testing of thermal transferability

The dyes used were tested as follows:

The polyester sheet donor containing the in-test dye in the coated front was placed face down on a sheet of commercially available Hitachi color video print paper receptor and pressed down. Donor/receptor were then wrapped in aluminum foil and heated between two hotplates at various temperatures T (within the temperature range 70° C.$<T<$120° C.). The amount of dye diffusing into the bright plastics layer of the receptor is proportional to the optical density (=absorbance A). The latter was determined photometrically. The plots of the logarithm of the absorbance A of the colored receptor papers measured within the temperature range from 80° to 110° C. against the reciprocal of the corresponding absolute temperature are straight lines from whose slope it is possible to calculate the activation energy $E_T$ for the transfer experiment:

$$\Delta E_T = 2.3 \cdot R \cdot \frac{\Delta \log A}{\Delta\left[\frac{1}{T}\right]}$$

To complete the characterization, the plots additionally reveal the temperature T*[° C.] at which the absorbance A of the colored receptor papers attains the value 1.

The dyes listed below in the tables were processed according to A) and the dye-coated transfers obtained were tested for their transfer characteristics according to B). The tables show in each case the thermotransfer parameters T* and $\Delta E_T$, the absorption maxima of the dyes $\lambda_{max}$ (measured in methylene chloride) and the binders used.

The key to the abbreviations is as follows:

B=binder

EC=ethylcellulose

MX=mixture of polyvinyl butyrate:EC=2:1

V=polyester

TABLE 1

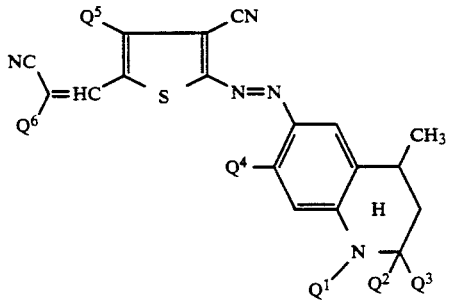

| Example No. | $Q^1$ | $Q^2$ | $Q^3$ | $Q^4$ | $Q^5$ | $Q^6$ | $\lambda_{max}$ [nm] | B | T* [°C.] | $\Delta E_T \left[\frac{kcal}{mol}\right]$ |
|---|---|---|---|---|---|---|---|---|---|---|
| 1 | H | $CH_3$ | $CH_3$ | H | Cl | $CO_2C_4H_9$ | 634 | MX | 95 | 12 |
| 2 | $C_2H_5$ | $CH_3$ | $CH_3$ | H | Cl | $CO_2C_4H_9$ | 667 | EC | 109 | 13 |
| 3 | $C_4H_9$ | $CH_3$ | $CH_3$ | H | Cl | $CO_2C_4H_9$ | 668 | MX | 93 | 14 |
| 4 | $C_4H_9OC_2H_4$ | $CH_3$ | $CH_3$ | H | Cl | $CO_2C_4H_9$ | 659 | MX | 90 | 13 |
| 5 | H | $CH_3$ | $CH_3$ | $CH_3$ | Cl | $CO_2C_4H_9$ | 643 | MX | 98 | 15 |
| 6 | H | $CH_3$ | $CH_3$ | $CH_3$ | Cl | CN | 670 | EC | 89 | 18 |
| 7 | H | $CH_3$ | $CH_3$ | $CH_3$ | Cl | $CO_2CH(CH_3)C_7H_{15}$ | 644 | MX | 99 | 16 |
| 8 | $C_3H_7$ | $CH_3$ | $CH_3$ | $CH_3$ | Cl | $CO_2C_4H_9$ | 669 | MX | 100 | 15 |
| 9 | H | $CH_3$ | $CH_3$ | $CH_3$ | Cl | $CO_2C_2H_4OC_4H_9$ | 644 | MX | 108 | 13 |
| 10 | H | $CH_3$ | $CH_3$ | $CH_3$ | Cl | $CO_2(C_2H_4O)_2C_4H_9$ | 646 | MX | 103 | 17 |
| 11 | H | $CH_3$ | $CH_3$ | H | Cl | $CO_2(C_2H_4O)_2C_4H_9$ | 635 | MX | 97 | 17 |
| 12 | $C_4H_9OC_2H_4$ | $CH_3$ | $CH_3$ | $CH_3$ | Cl | $CO_2C_4H_9$ | 660 | V | 102 | 14 |
| 13 | H | $CH_3$ | $CH_3$ | $CH_3$ | Cl | $CO_2CH(CH_3)_2$ | 638 | V | 110 | 14 |
| 14 | $C_4H_9OC_2H_4$ | $CH_3$ | $CH_3$ | $NHCOCH_3$ | Cl | $CO_2C_4H_9$ | 664 | V | 120 | 15 |
| 15 | $C_4H_9OC_2H_4$ | $CH_3$ | $CH_3$ | H | Cl | $CO_2CH(CH_3)_2$ | 657 | V | 91 | 15 |
| 16 | $C_6H_{13}$ | $CH_3$ | $CH_3$ | H | $C_6H_5$ | $CO_2C_7H_{15}$ | 668 | MX | 102 | 16 |

TABLE 2

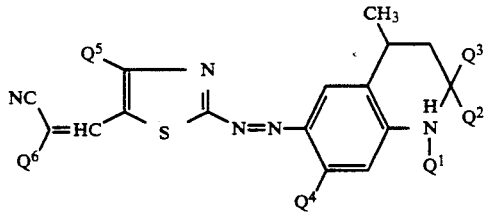

| Example No. | $Q^1$ | $Q^2$ | $Q^3$ | $Q^4$ | $Q^5$ | $Q^6$ | $\lambda_{max.}$ [nm] | B | T* [°C.] | $\Delta E_T \left[\frac{kcal}{mol}\right]$ |
|---|---|---|---|---|---|---|---|---|---|---|
| 12 | $C_2H_4OC_4H_9$ | $CH_3$ | $CH_3$ | $CH_3$ | Cl | $CO_2C_4H_9$ | 635 | MX | 98 | 18 |
| 18 | $C_2H_4OC_4H_9$ | $CH_3$ | $CH_3$ | H | Cl | $CO_2C_5H_{11}$ | 628 | MX | 97 | 19 |
| 19 | $C_2H_4OC_4H_9$ | $CH_3$ | $CH_3$ | $CH_3$ | Cl | $CO_2CH(CH_3)_2$ | 636 | MX | 102 | 14 |
| 20 | $C_2H_4OC_4H_9$ | $CH_3$ | $CH_3$ | $CH_3$ | Cl | $CO_2C_4H_4OC_4H_9$ | 642 | EC | 106 | 19 |
| 21 | $C_2H_5$ | $CH_3$ | $CH_3$ | $CH_3$ | Cl | $CO_2C_4H_9$ | 641 | MX | 101 | 16 |
| 22 | H | $CH_3$ | $CH_3$ | $CH_3$ | Cl | CN | 644 | MX | 103 | 22 |
| 23 | $C_3H_7$ | $CH_3$ | $CH_3$ | $CH_3$ | Cl | CN | 670 | EC | 100 | 21 |
| 24 | $C_2H_4OC_4H_9$ | $CH_3$ | $CH_3$ | $CH_3$ | Cl | CN | 666 | MX | 102 | 20 |

TABLE 3

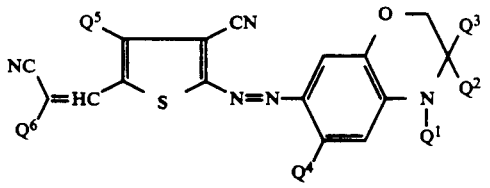

| Example No. | $Q^1$ | $Q^2$ | $Q^3$ | $Q^4$ | $Q^5$ | $Q^6$ | B | T* [°C.] | $\Delta E_T \left[\frac{kcal}{mol}\right]$ |
|---|---|---|---|---|---|---|---|---|---|
| 25 | H | H | $CH_3$ | H | Cl | $CO_2C_4H_9$ | MX | 101 | 17 |
| 26 | $C_2H_5$ | H | $CH_3$ | $CH_3$ | Cl | $CO_2C_6H_{13}$ | MX | 98 | 15 |
| 27 | $C_2H_4OC_4H_9$ | H | H | H | Cl | $CO_2C_2H_4OC_4H_9$ | MX | 102 | 14 |
| 28 | $C_3H_7$ | H | $CH_3$ | H | $CH_3$ | $CO_2(CH_2)_2CH(CH_3)_2$ | MX | 104 | 16 |
| 29 | $C_2H_4OC_4H_9$ | H | $CH_3$ | H | Cl | CN | V | 100 | 20 |

We claim:

1. A process comprising transferring azo dyes from a transfer to a sheet of plastic-coated paper by diffusion by means of an energy source, on which transfer there is one or more azo dyes of the formula I

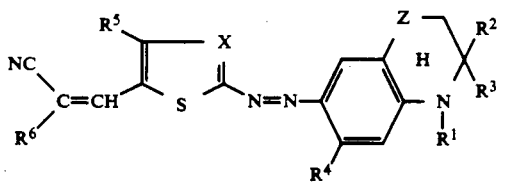

(I)

where

X is nitrogen or the radical C—CN,

Z is oxygen or the radical —CH($R^7$)—, and $R^7$ is hydrogen or $C_1$–$C_4$-alkyl, $R^1$ is alkyl, alkanoyloxyalkyl, alkoxycarbonyloxyalkyl or alkoxycarbonylalkyl, which each have up to 15 carbon atoms and may be substituted by phenyl, $C_1$–$C_4$-alkylphenyl, $C_1$–$C_4$-alkoxyphenyl, halophenyl, benzyloxy, $C_1$–$C_4$-alkylbenzyloxy, $C_1$–$C_4$-alkoxybenzyloxy, halogen, hydroxyl or cyano; hydrogen, unsubstituted or $C_1$–$C_{15}$-alkyl-, $C_1$–$C_{15}$-alkoxy- or halogen-substituted phenyl; or a radical of the formula II $$(-Y-O)_m-R^8 \quad \text{(II)}$$

where

Y is $C_2$–$C_6$-alkylene, m is 1, 2, 3, 4, 5 or 6, and $R^8$ is $C_1$–$C_4$-alkyl or unsubstituted or $C_1$–$C_4$-alkyl- or $C_1$–$C_4$-alkoxy-substituted phenyl, $R^2$ and $R^3$ are identical or different and each is independently of the other hydrogen or $C_1$–$C_4$-alkyl, $R^4$ is hydrogen, $C_1$–$C_{10}$-alkyl, $C_1$–$C_{10}$-alkoxy or the radical—NH—$COR^2$ or —$NHSO_2R^8$, where $R^2$ and $R^8$ are each as defined above, $R^5$ is hydrogen, chlorine, $C_1$–$C_4$-alkyl, $C_1$–$C_4$-alkoxy, $C_1$–$C_4$-alkylthio or unsubstituted or $C_1$–$C_4$-alkyl-, $C_1$–$C_4$-alkoxy- or halogen-substituted phenyl, and $R^6$ is cyano or the radical —CO—$OR^1$, —CO—$NHR^1$ or —CO—$N(R^1)_2$, in each of which $R^1$ is as defined above.

2. A process as claimed in claim 1, wherein there is on the transfer one or more azo dyes of the formula I where $R^1$ is alkyl, alkanoyloxyalkyl or alkyloxycarbonylalkyl, which each have up to 12 carbon atoms and may be substituted by hydroxyl or cyano, or a radical of the formula II $$[-Y-O]_m-R^8 \quad \text{(II)}$$

where

Y is $C_2$–$C_4$-alkylene, m is 1, 2, 3 or 4, and $R^8$ is $C_1$–$C_4$-alkyl or unsubstituted or $C_1$–$C_4$-alkyl- or $C_1$–$C_4$-alkoxy-substituted phenyl, $R^4$ is hydrogen, $C_1$–$C_6$-alkyl, $C_1$–$C_6$-alkoxy or the radical —NH—$COR^2$ or —$NHSO_2R^8$, where $R^2$ and $R^8$ are each as defined above, $R^5$ is hydrogen, chlorine, $C_1$–$C_4$-alkyl, $C_1$–$C_4$-alkoxy or phenyl, and $R^6$ is cyano or the radical —CO—$OR^1$, —CO—$NHR^1$ or —CO—$N(R^1)_2$, in each of which $R^2$ is as defined above.

3. A process as claimed in claim 1, wherein there is on the transfer one or more azo dyes of the formula Ia

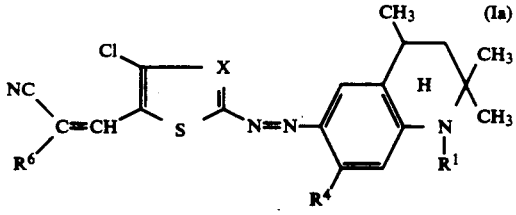

(Ia)

where

X is nitrogen or the radical C—CN, $R^1$ is $C_1$–$C_6$-alkyl or a radical of the formula III $$[-CH_2-CH_2-O]_n-R^8 \quad \text{(III)}$$

where n is 1 or 2 and $R^8$ is $C_1$–$C_4$-alkyl, $R^4$ is hydrogen, methyl, methoxy or $C_2$–$C_5$-alkanoylamino, and $R^6$ is cyano or the radical —CO—$OR^1$, where $R^1$ is as defined above.

* * * * *